US005209196A

United States Patent [19]

Nickel et al.

[11] Patent Number: 5,209,196

[45] Date of Patent: May 11, 1993

[54] OPERATING-MODE POSITION SELECTOR ARRANGEMENT FOR INTERNAL COMBUSTION ENGINE

[75] Inventors: Hans Nickel, Cottenweiler; Michael Wissmann, Schorndorf-Weiler, both of Fed. Rep. of Germany

[73] Assignee: Andreas Stihl, Waiblingen, Fed. Rep. of Germany

[21] Appl. No.: 884,206

[22] Filed: May 18, 1992

[30] Foreign Application Priority Data

May 18, 1991 [DE] Fed. Rep. of Germany ..... 4116395

[51] Int. Cl.[5] ..... F02P 11/00; F02M 1/00

[52] U.S. Cl. ..... 123/179.5; 123/179.18; 123/198 DC

[58] Field of Search ..... 123/179.5, 179.18, 179.16, 123/198 DC

[56] References Cited

U.S. PATENT DOCUMENTS

| | | | |
|---|---|---|---|
| 2,791,207 | 5/1957 | Rayniak | 123/198 DC |
| 2,935,977 | 5/1960 | Eberline | 123/198 DC |
| 4,079,708 | 3/1978 | Wieland et al. | 123/179.18 |
| 4,919,091 | 4/1990 | Wissmann et al. | 123/179.5 |

*Primary Examiner*—Andrew M. Dolinar

*Attorney, Agent, or Firm*—Walter Ottesen

[57] ABSTRACT

The invention relates to an operating-mode position selector arrangement for an internal combustion engine in a portable handheld tool such as a motor-driven chain saw. The engine includes an electrical ignition system and is supplied with a fuel mixture by a carburetor. In a start position of the operating-mode position selector, the position selector holds the choke flap and the throttle flap of the carburetor in pregiven start positions. In an operating position of the operating-mode position selector, the throttle flap is released for actuation via a throttle lever and the choke flap is fully opened. In a stop position of the operating-mode position selector, an electric contact is closed between a terminal of the electric ignition system and ground. The different positions of the operating-mode position selector are detected electrically. This is achieved in that for the operating position of the operating-mode position selector, the terminal of the electric ignition system is connected to ground via a further electric contact and a resistor. In this way, the operating position of the operating-mode position selector can be distinguished from the stop position and the start position because of the different voltages which adjust in each position.

5 Claims, 3 Drawing Sheets

Fig. 2
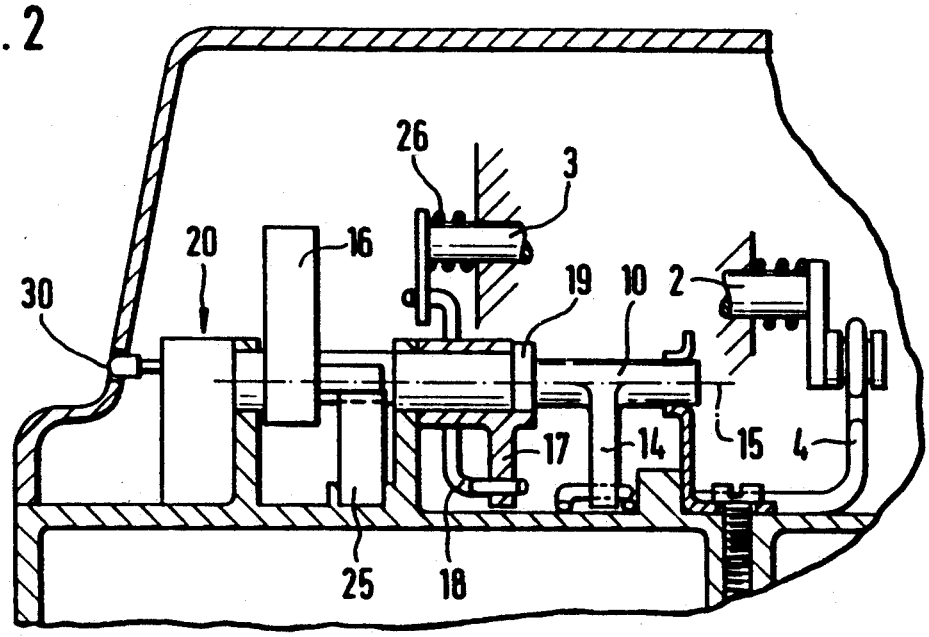
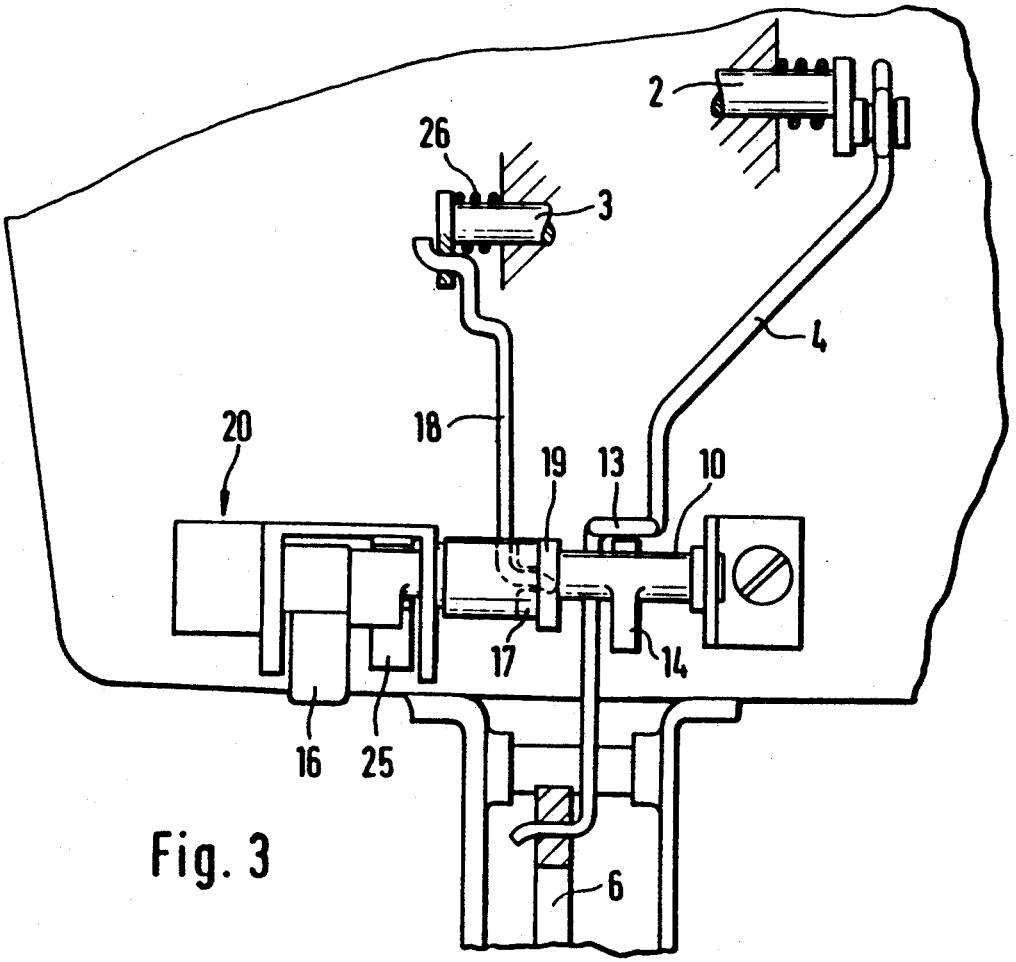
Fig. 3

OPERATING-MODE POSITION SELECTOR ARRANGEMENT FOR INTERNAL COMBUSTION ENGINE

BACKGROUND OF THE INVENTION

An operating-mode position selector is disclosed in German published patent application 2,509,443 wherein the ignition system is connected to ground in the stop position for switching off the engine; that is, the ignition system is short-circuited. The ignition system is switched on in the operating position as well as in the start position (start gas or choke).

For optimizing the performance of an engine, especially a two-stroke engine, as well as for optimizing its performance with respect to exhaust gas, electronic ignition systems are utilized which, for example, adjust the ignition pursuant to a so-called characteristic field in order to obtain an ignition adapted to the particular operating state of the engine.

Such electronic ignition systems are mostly configured by utilizing a microprocessor. In these systems, a shift in ignition in the direction of retarded ignition is possible for the start of the engine whereby the starting operation of an engine started mostly with a pull rope is simpler and a kickback is reliably avoided. For adjusting the retarded ignition, it is necessary to reliably detect the start position of the engine.

SUMMARY OF THE INVENTION

It is an object of the invention to provide an operating-mode position selector arrangement wherein the ignition system can reliably distinguish the start position of the selector from the operating position or stop position thereof.

The operating-mode position selector arrangement of the invention is for an internal combustion engine in a portable handheld apparatus such as a motor-driven chain saw. The engine includes: an electrical ignition system, an intake channel, a throttle lever, a choke flap pivotally mounted in the intake channel and a fuel-metering device for supplying an air/fuel mixture to the engine. The operating-mode position selector arrangement includes: an operating-mode position selector mounted on the apparatus so as to be movable between a start position, an operating position and a stop position; starter means mounted in the fuel-metering device and being movable between an at-rest position wherein the starter means does not influence the metering of fuel in the air/fuel mixture and an in-service position for increasing the quantity of fuel in the air/fuel mixture; first connecting means operatively connecting the position selector to the starter means for holding the starter means in the in-service position when the position selector is in the start position; means for bringing the starter means into the at-rest position when said position selector is moved into the operating position; linkage means operatively connecting the throttle lever to the throttle flap; second connecting means for holding the throttle flap in a first position when the position selector is in the start position; means for releasing the throttle flap for actuation via the throttle lever and the linkage means when the position selector is moved into the operating position; the ignition system having a system terminal; a ground terminal; a resistance means; and, switching means operatively connected to the position selector for connecting the system terminal to ground in the stop position and for connecting the resistance means between the terminals when the position selector is moved into the operating position.

The short-circuit switch which is provided for switching off the engine is expanded by an additional contact which is connected to the ignition via a resistor. Supplementing the short-circuit switch in this manner makes it possible to reliably distinguish the start position, operating position and stop position. In the stop position, the ignition is switched to ground so that a voltage drop cannot occur. In the operating position, the ignition is switched to ground via a resistor and, for this reason, there is a corresponding voltage drop across the resistor. This voltage drop is detected by the electronic ignition and is evaluated. The ignition system itself remains fully operational because of the resistor mounted as described above. In the start position, the ignition terminal is open so that there is an idle voltage relative to ground which provides information to the ignition system as to the start position.

In a further embodiment of the invention, a light-emitting diode is provided as a resistor so that the operating state of the engine (that is, the switched-on ignition) can be displayed optically to the user. The light-emitting diode is advantageously used as an adjustment display for the carburetor so that separately provided displays are unnecessary.

BRIEF DESCRIPTION OF THE DRAWINGS

The invention will now be described with reference to the drawings wherein:

FIG. 2 is a section view taken along line II-II of FIG. 1;

FIG. 3 is a schematic plan view of an operating-mode position selector according to the invention;

DESCRIPTION OF THE PREFERRED EMBODIMENTS OF THE INVENTION

Figure 1:
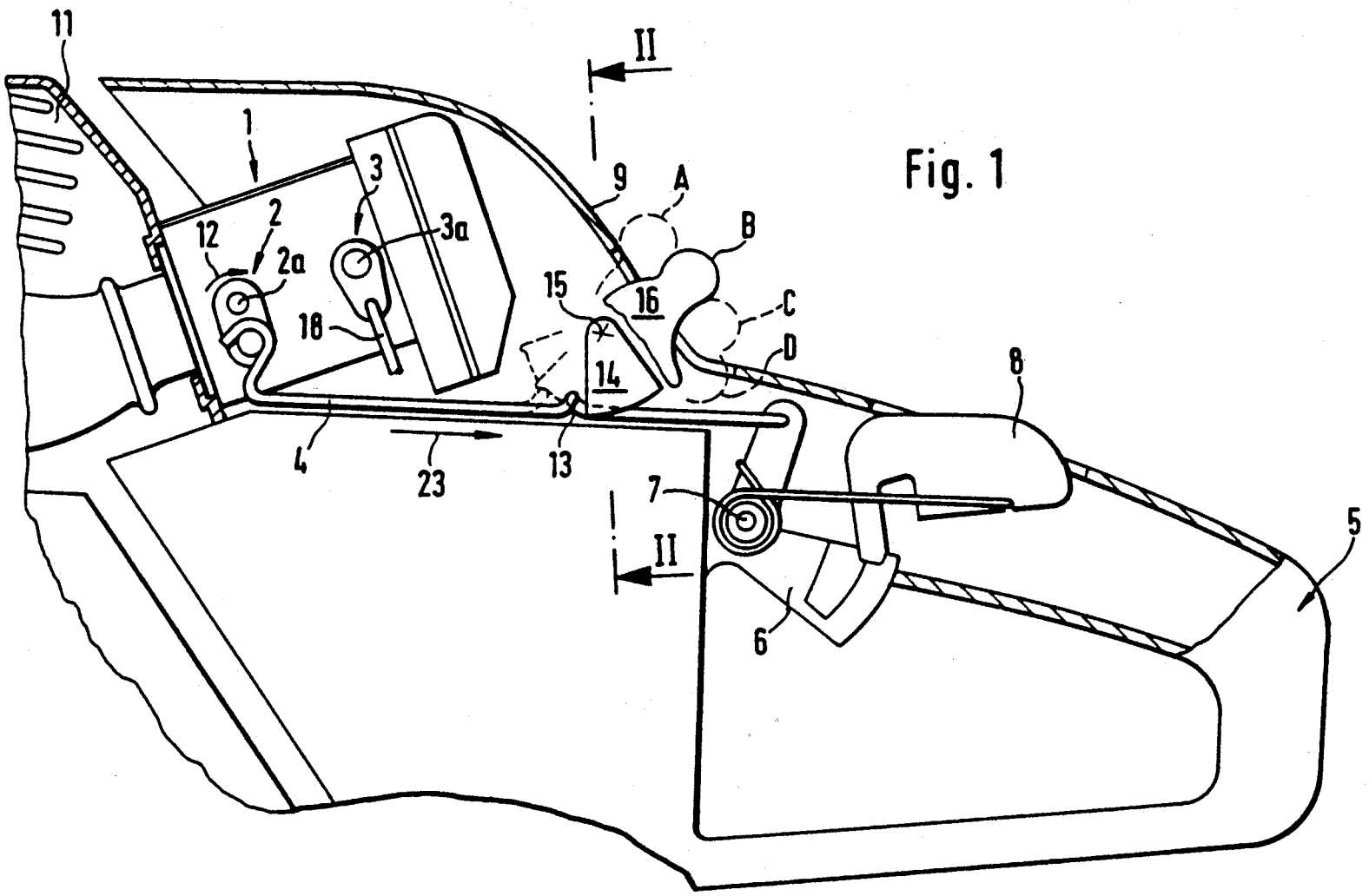
FIG. 1 is a schematic, partially in section, of a portion of a handheld portable tool having an internal combustion engine.
Figure 4:
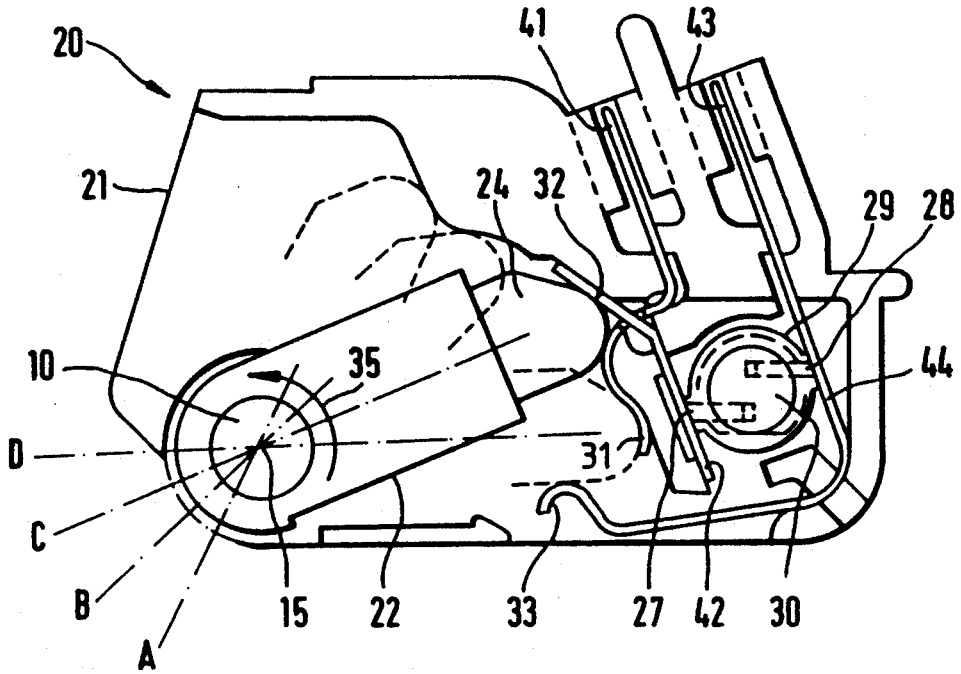
FIG. 4 is a view of an electric switch coupled to the operating-mode position selector; and, FIG. 5 is a schematic circuit diagram of the electric switch of FIG. 4.

The portable handheld tool shown in FIG. 1 is a motor-driven chain saw. An internal combustion engine is provided as a drive motor and is especially a two-stroke engine. The engine is supplied with a fuel mixture via a metering device which is here shown as a carburetor 1. A throttle flap 2 and a starter flap 3 (choke flap) are mounted in the intake pipe of the carburetor 1. The flaps 2 and 3 are pivotally mounted in the carburetor housing by means of shafts *2a* and *3a*, respectively.

The throttle flap 2 is connected via a throttle linkage 4 to a throttle lever 6 journalled in a handle 5. The throttle lever 6 can be pivoted about a pin 7. A throttle lever latch 8 is provided for the throttle lever 6.

As shown in FIGS. 1 to 3, the throttle linkage 4 has an offset portion 13 which coacts with a position lever 14. The position lever 14 is fixedly mounted on a shaft 10 so as to rotate therewith. The shaft 10 can be pivoted about the axis 15 via an operating-mode position selector 16. The operating-mode position selector 16 projects out of the housing 9 of the chain saw on the upper side of the handle 5 and is easily actuated by the thumb of the hand holding the handle 5.

A starter-flap lever 17 is also connected to the shaft 10 journalled in the housing. The starter flap 3 is pivotable through a pregiven angular range by means of a dog 19 mounted on the shaft 10 so as to rotate therewith. This action is achieved via a starter-flap linkage 18 when there is a rotation of the shaft 10.

The throttle linkage 4 is spring biased in the closure direction of the throttle flap 2 in the direction of arrow 23 (FIG. 1) so that the throttle flap automatically reaches its closed position when the throttle lever 6 is released provided the position lever 14 is not disposed in the working region of the offset portion 13 of the throttle linkage 4.

The starter flap 3 (choke flap) is resiliently biased into its at-rest position by means of a spring 26 mounted on the shaft 3*a*. Likewise, the shaft 10 of the operating-mode position selector 16 is provided with a return spring 25 which becomes effective after the warm-start position.

In the embodiment shown, the operating-mode position selector 16 can assume four positions. In a rotational direction of the shaft 10 corresponding to the opening direction 12 of the throttle flap 2, these positions are sequentially the following: a stop position D, an operating-mode position C corresponding to idle, a warm-start position B and a cold-start position A.

In the cold-start position A and because of the position of the operating-mode position selector 16, the starter flap 3 is pivoted into its effective operating position in order to effect a mixture enrichment corresponding to the cold start. This movement of the starter flap 3 is achieved via the start flap lever 17 and the dog 19. At the same time, the throttle flap 2 is held in a start position via the position lever 14. In this start position, and without moving back the operating-mode position selector 16, the throttle flap is pivotable in the direction of a further opening of the intake channel via actuation of the throttle lever 6.

In the warm-start position B of the operating-mode position selector 16, the starter flap 3 is preferably held in an at-rest position via the starter -flap linkage 18 while the throttle flap 2 is latched in a start position by the position lever 14. When the throttle lever 6 is actuated, the latch is released whereby the operating-mode position selector 16 pivots back into its operating position C because of the effective spring forces. In the operating position C, the throttle flap is completely released for actuation via the throttle lever 6 and the starter flap 3 is pivoted into its at-rest position under the action of spring 26; that is, the starter flap 3 completely clears the intake channel.

In the stop position D of the operating-mode position selector 16, the ignition of the engine is switched to ground via an electric switch 20, that is, the ignition is short circuited. In this way, the ignition is suppressed so that the engine comes to stand-still.

In the embodiment shown, the switch 20 is fixed to the housing and mounted at the end of the shaft 10 of the operating-mode position selector 16. In the housing 21 of the switch 20, a contact finger 22 is provided which is fixedly mounted to the shaft 10 of the operating-mode position selector 16 so as to rotate with the shaft and can thereby be pivoted with the position selector 16. The contact finger 22 has a head 24 made of electrically-conducting material and contact tongues 31, 32 and 33 project into the pivot plane of the head 24. The contact tongues 31 to 33 are fixed in the housing 21 of the switch 20 with their ends 41 to 43 facing away from the contact finger 22. The ends 41 and 43 of the contact tongues 31 and 33, respectively, preferably define insert contacts for connecting to external leads. For this reason, the ends 41 and 43 are accessible from outside of the housing 21 of the switch 20.

The end 42 of the contact tongue 32 lies approximately parallel to a longitudinal segment 44 of the contact tongue 33 with a resistor, preferably a light-emitting diode 30, being mounted between the longitudinally extending end 42 of the contact tongue 32 and the longitudinal segment 44 of the contact tongue 33. For this purpose, an insert mount 29 is arranged in the region of the switch housing 21 between the longitudinal segment 44 and the longitudinally extending end 42 of the contact tongue 32. The contacts 28 and 27 of the insert mount 29 are electrically connected to the longitudinal segment 44 and the end 42, respectively.

The contact tongue 31 lies closer to the contact tongue 33 than the contact tongue 32 when viewed in the direction of rotation 35 of the contact finger 22 and the shaft 10.

Figure 5:
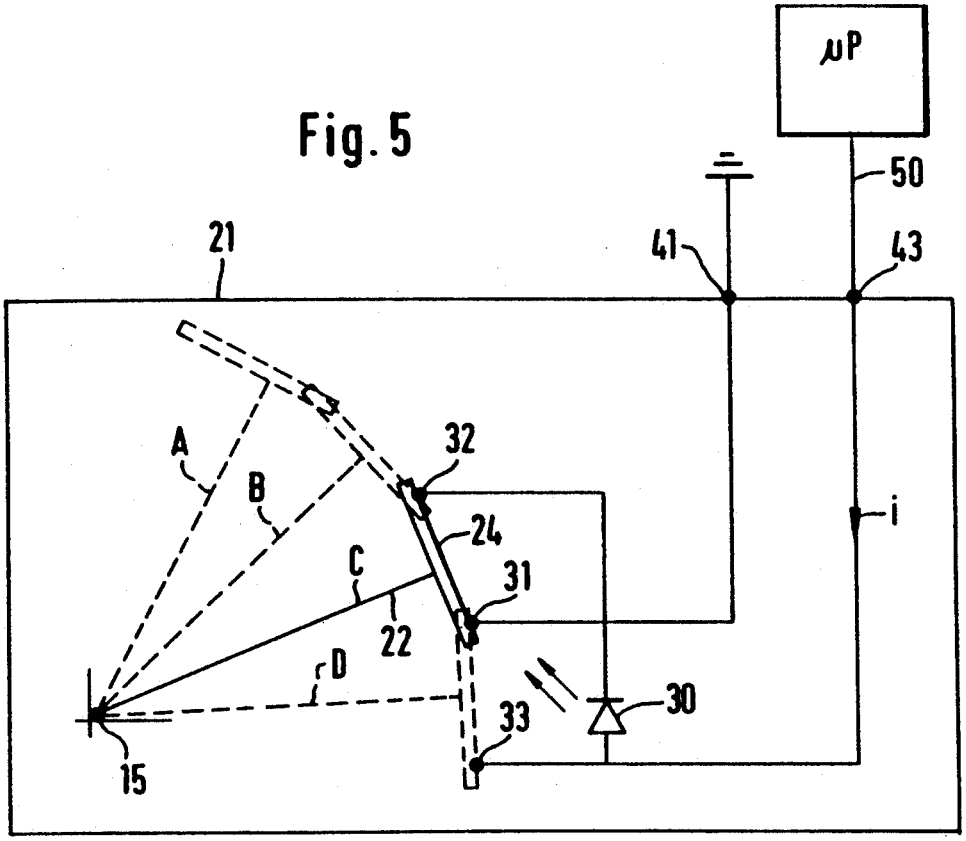

The switch 20 is electrically connected as shown in the circuit schematic of FIG. 5. The end 43 of the contact tongue 33 is connected to the ignition; in the embodiment shown, the end 43 is connected to a control terminal of a microprocessor defining the ignition. The end 41 of the contact tongue 31 is connected to ground.

In the operating position D of the operating-mode position selector 16, the contact finger 24 connects the contact tongues 31 and 33 electrically to each other so that the terminal 50 of the ignition is connected directly to ground. The ignition is short circuited and no potential difference is present between the points 41 and 43.

In the operating position C of the operating-mode position selector 16, the contact finger 24 connects the electrical contacts 31 and 32 to each other so that the control terminal 50 of the ignition is connected via the resistor, preferably the light-emitting diode 30, to ground. A potential difference is present between the points 41 and 43 which corresponds to the voltage drop at the resistor or the light-emitting diode 30.

In a start position (A or B), the contact finger 24 is pivoted out of the effective range of the contact tongues 31, 32 and 33 so that the control terminal 50 is open. An idle voltage adjusts between the points 41 and 43.

The microprocessor defining the ignition can distinguish the stop position (potential difference $=0$), the operating position (potential difference equal to the voltage dropping across the light-emitting diode) and also the start position (idle voltage) because of the potential difference occurring between the points 41 and 43. Accordingly, the ignition of the engine can be adjusted in correspondence to the position of the operating-mode position selector. In this way, it is ensured that an optimal ignition position is obtained for each operating state of the engine.

The light-emitting diode 30 is easily exchangeable and is advantageously used as a setting display for the carburetor adjustment. This is possible since short current pulses transmitted by the microprocessor are adequate for detecting the position of the operating-mode position selector 16. These current pulses are then so dimensioned that a visible luminescence of the light-emitting diode 30 does not occur. Only with an optimal adjustment of the carburetor does the microprocessor raise the current (i) in such a manner that the light-emitting diode 30 becomes illuminated so that it is visible and displays the optimal idle position of the carburetor to the operator of the portable handheld tool.

The operating-mode position selector can be used not only in combination with a carburetor but also with an injection pump. Furthermore, the configuration of the selector is also useable in other applications and always when three positions of a position selector are to be detected with only two lines.

It is understood that the foregoing description is that of the preferred embodiments of the invention and that various changes and modifications may be made thereto without departing from the spirit and scope of the invention as defined in the appended claims.

What is claimed is:

1. An operating-mode position selector arrangement for an internal combustion engine in a portable handheld apparatus such as a motor-driven chain saw, the engine including: an electrical ignition system, a fuel-metering device for supplying an air/fuel mixture to the engine, the fuel-metering device including an intake channel for conducting the air/fuel mixture to the engine, a throttle lever, a throttle flap pivotally mounted in the intake channel and a fuel-metering device for supplying an air/fuel mixture to the intake channel of the engine, the operating-mode position selector arrangement comprising:

operating-mode position selector mounted on said apparatus so as to be movable between a start position, an operating position and a stop position;

starter means mounted in said intake channel and being movable between an at-rest position wherein said starter means does not influence the metering of fuel in said air/fuel mixture and an in-service position for increasing the quantity of fuel in said air/fuel mixture;

first connecting means operatively connecting said position selector to said starter means for holding said starter means in said in-service position when said position selector is in said start position;

means for bringing said starter means into said at-rest position when said position selector is moved into said operating position;

linkage means operatively connecting said throttle lever to said throttle flap;

second connecting means for holding said throttle flap in a first position when said position selector is in said start position;

means for releasing said throttle flap for actuation via said throttle lever and said linkage means when said position selector is moved into said operating position;

said ignition system having a system terminal;

a ground terminal;

a resistance means; and, switching means operatively connected to said position selector for connecting said system terminal to ground in said stop position and for connecting said resistance means between said terminals when said position selector is moved into said operating position.

2. The operating-mode position selector arrangement of claim 1, said position selector including a shaft pivotally mounted on said apparatus; said switching means including: a contact finger fixedly mounted on said shaft so as to pivot therewith to define a pivot plane; first, second and third contact tongues lying in said pivot plane; said first contact tongue being connected to said system terminal, said second contact tongue being connected via said resistance means to said first contact tongue; and, said third contact tongue being connected to said ground terminal.

3. The operating-mode position selector arrangement of claim 2, said first and second contact tongues having respective first and second segments which are mutually parallel; said switching means further including insert means for receiving said resistance means therein; and, said insert means being connected between said segments.

4. The operating-mode position selector arrangement of claim 3, said resistance means being a light-emitting diode.

5. The operating-mode position selector arrangement of claim 4, said fuel-metering device including a carburetor and said diode being an adjustment display for said carburetor.

* * * * *